US007544223B2

(12) United States Patent
Oda et al.

(10) Patent No.: US 7,544,223 B2
(45) Date of Patent: Jun. 9, 2009

(54) AIR CONDITIONER

(75) Inventors: Masato Oda, Kanagawa (JP); Jun Kakudate, Kanagawa (JP); Hiroyuki Hamano, Kanagawa (JP)

(73) Assignee: Fujitsu General Limited, Kanagawa (JP)

( * ) Notice: Subject to any disclaimer, the term of this patent is extended or adjusted under 35 U.S.C. 154(b) by 701 days.

(21) Appl. No.: 11/216,032

(22) Filed: Sep. 1, 2005

(65) Prior Publication Data

US 2006/0070358 A1 Apr. 6, 2006

(30) Foreign Application Priority Data

Sep. 2, 2004 (JP) ..... P.2004-255118
Sep. 3, 2004 (JP) ..... P.2004-256471

(51) Int. Cl.
*B01D 46/18* (2006.01)
*B01D 46/42* (2006.01)
*F24F 1/00* (2006.01)

(52) U.S. Cl. ..... 55/289; 55/283; 55/290; 55/471; 55/472; 55/473; 55/351; 55/352; 55/353; 55/354; 55/295; 55/296; 55/297; 55/298; 55/299; 55/300

(58) Field of Classification Search ..... 55/283, 55/289, 290, 471–473, 351–354, 295–300
See application file for complete search history.

(56) References Cited

U.S. PATENT DOCUMENTS 399,984 A * 3/1889 Gessl ..... 55/290
484,717 A * 10/1892 Ince ..... 55/290
2,012,250 A * 8/1935 Rundell ..... 131/314
2,639,780 A * 5/1953 Hardy ..... 55/296
3,252,691 A * 5/1966 Getzin et al. ..... 261/80
3,487,620 A * 1/1970 Klein et al. ..... 96/277
4,435,909 A * 3/1984 Williamson, Jr. ..... 34/82
5,217,513 A * 6/1993 Armbruster ..... 96/414
5,762,689 A * 6/1998 Hunziker ..... 95/280
7,276,108 B2 * 10/2007 Wei et al. ..... 95/282

FOREIGN PATENT DOCUMENTS

JP 6-114224 A * 4/1994 ..... 55/351
JP 2004-28487 1/2004

* cited by examiner

*Primary Examiner*—Duane Smith
*Assistant Examiner*—Minh-Chau T Pham
(74) *Attorney, Agent, or Firm*—Venable LLP; Michael A. Sartori; Steven J. Schwarz

(57) ABSTRACT

An inner portion of a filter cleaning portion 300 arranged at an inner portion of an interior unit is respectively arranged with cleaning units 300A, 300B constituted by arranging upper brushes 344*a*, 344*b* brought into contact with one face of an air filter and lower brushes 322*a*, 322*b* brought into contact with other face of the air filter 5 opposedly to each other at filter inlet/outlet 350*a*, 350*b* of the filter cleaning portion 300. Further, a longitudinal frame 54 and a transverse frame 55 of an air filter 5 having a filter sheet 51 in a shape of a meshed sheet for catching dust and a frame 52 for supporting the filter sheet 51 are formed on a rear face side (side of heat exchanger 3) of the filter sheet 51.

16 Claims, 10 Drawing Sheets

AIR CONDITIONER

BACKGROUND OF THE INVENTION

The present invention relates to an air conditioner having a filter cleaning function for automatically cleaning a stained air filter, further in details, relates to an air conditioner having a filter cleaning function capable of firmly removing dust adhered to an air filter without scattering dust to a surrounding thereof.

An air conditioner (interior unit thereof) is attached with a dust preventing air filter for preventing dust from flowing from an air suction port to inside thereof. Normally, the air filter is attachably and detachably attached to the interior unit and a user cleans the air filter at pertinently timings.

However, since an air conditioner is generally provided at a high place in a room, an operation of detaching the air filter is troublesome and becomes an operation particularly difficult for an aged or female person. Hence, the applicant has proposed an air conditioner automating an operation of cleaning the air filter.

As an example thereof, according to the invention described in Patent Reference 1, an air filter is made to be movable, inside of an interior unit is provided with an air filter cleaning portion in which a cleaning brush is made to be included in a dust box, and the air filter is automatically cleaned by passing the air filter through the dust box.

According thereto, although the air filter can be cleaned without manual labor, there is constituted a structure of passing the air filter through the dust box to thereby scrape off dust adhered thereto by the brush. Here, in order to prevent scraped dust from being carried out from the dust box in accordance with movement of the air filter, a scraper is provided at a filter inlet/outlet of the dust box. Although the scraper is opened in moving forward the air filter and closed in moving rearward the air filter by detecting movement of the air filter, an opening and closing structure thereof is complicated.

Further, although according to the invention described in Patent Reference 1, there is used a special filter constituted by integrally molding a filter having small contact resistance between the filter and the brush and a frame, when the air filter is constituted by an integrally molded product, molding cost is increased. Further, since the air filter is thickened, a draft resistance is liable to be increased.

Although in order to resolve the problems, the problem is resolved by using an air filter expanded with a meshed sheet of a background art type, when the meshed sheet is used, a brush is liable to be caught by the mesh, and the contact resistance becomes excessively large. Therefore, a motor having a high torque is needed for moving the filter.

Further, according to Patent Reference 1, inside of the interior unit is provided with a filter cleaning portion including the dust box having the cleaning brush and the dust box is provided with a total of three portions of cleaning brushes of two cleaning brushes for cleaning a surface side (air suction port side) of the filter and one cleaning brush for cleaning a rear face side (heat exchanger side) thereof.

According thereto, by reciprocating the filter inward/outward of the interior unit by passing through the dust box, dust adhered to the filter is scraped off by the cleaning brush in the dust box and scraped dust can be stored in the dust box.

However, there is also a case in which according to the filter cleaning portion of the background art, at respective times of reciprocating the filter through the cleaning portion by a number of times, a tip of inclined brush is curled and a scraping effect thereof is reduced of time. [Patent Reference 1] JP-A-2004-28487

SUMMARY OF THE INVENTION

The invention is carried out in order to resolve the above-described problems and it is an object thereof to provide an air conditioner having a filter cleaning function capable of firmly removing dust adhered to an air filter and firmly storing removed dust without scattering the dust to a surrounding thereof even by a simple constitution, and an air conditioner having a filter cleaning function in which a recovering function is not deteriorated even by a long time period of use.

In order to achieve the above-described object, the invention is provided with a number of characteristics shown below. First, according to an embodiment of the invention, there is provided an air conditioner including:

an interior unit cabinet having an air suction port and an air blow out port and arranged with an air filter on an inner side of the air suction port, inside of the interior unit cabinet, a filter cleaning portion having a cleaning case surrounding both of a surface and a rear face of a portion of the air filter, and in cleaning driving element for moving either one of the air filter or the filter cleaning portion for cleaning the air filter by moving the air filter and the filter cleaning portion relative to each other by the in cleaning driving element, wherein the filter cleaning portion includes: a first cleaning unit arranged on a filter inlet/outlet side on one side of the cleaning case, and a second cleaning unit arranged on a filter inlet/outlet side on other side of the cleaning case, and an interval between the respective cleaning units is allocated to a dust recovering portion.

According to an embodiment of the invention, there is provided an air conditioner, wherein cleaning brushes brought into contact with the air filter are included in the respective cleaning units, and both of the cleaning brushes are inclined brushes inclined to sides of the dust recovering portion.

According to an embodiment of the invention, there is provided an air conditioner, wherein the respective cleaning brushes includes upper brushes brought into contact with one face of the air filter and lower brushes brought into contact with other face of the air filter, and arranges the upper brushes and the lower brushes opposedly by interposing the air filter.

According to an embodiment of the invention, there is provided the air conditioner further including:

pressing element for pressing at least one of the upper brushes and the lower brushes to sides of the air filter inside of the cleaning case.

According to an embodiment of the invention, there is provided the air conditioner, wherein the cleaning case includes a bottom cover and a top cover integrated openably and closably, the two lower brushes included in the respective cleaning units are respectively supported by a side of the bottom cover, and the two upper brushes included in the respective cleaning units are respectively supported by a side of the top cover.

According to an embodiment of the invention, there is provided an air conditioner, wherein one of the upper brushes is supported by a first pivoting arm axially supported by the top cover, and other of the upper brushes is supported by a second pivoting arm axially supported by the top cover.

According to an embodiment of the invention, there is provided an air conditioner, wherein an axis fulcrum of the first pivoting arm relative to the top cover is arranged on a side of the other of the upper brushes, and an axis fulcrum of the second pivoting arm relative to the top cover is arranged on a side of the one of the upper brushes.

According to an embodiment of the invention, there is provided an air conditioner, wherein as the pressing element, a pressing cam operated selectively in accordance with a direction of moving the air filter is used.

According to an embodiment of the invention, there is provided an air conditioner including:

an interior unit cabinet having an air suction port and an air blow out port and arranged with an air filter on an inner side of the air suction port, inside of the interior unit cabinet, a filter cleaning portion having a cleaning brush brought into contact with at least one of a surface and a rear face thereof, and in cleaning driving element for moving either one of the air filter or the filter cleaning portion in a cleaning case surrounding a portion of the air filter for cleaning the air filter by the cleaning brush by moving the air filter and the filter cleaning portion relative to each other by driving the in cleaning driving element by controlling element, wherein a filter sheet in a meshed shape supported by a frame is used for the air filter, and in a main frame for supporting a peripheral edge of the filter sheet and a bridge frame for supporting a dust catching face of the filter sheet included in the frame, the bridge frame is arranged at least on a rear face side of the air filter.

According to an embodiment of the invention, there is provided an air conditioner, wherein the bridge frame includes: at least one of a longitudinal rail substantially in parallel with a direction of moving the air filter, and a transverse rail substantially orthogonal to the direction of moving the air filter, and the longitudinal rail and/or the transverse rail is formed so that a height thereof is gradually reduced as proceeding from a top portion thereof in a width direction in a sectional shape thereof.

According to an embodiment of the invention, there is provided an air conditioner, wherein the bridge frame includes: at least one of a longitudinal rail substantially in parallel with a direction of moving the air filter, and a transverse rail substantially orthogonal to the direction of moving the air filter, and the transverse rail is formed in a triangular shape in a section thereof including an inclined face inclined to the direction of moving the air filter gradually by a predetermined angle and an erected face erected substantially orthogonally to the direction of moving the air filter.

According to an embodiment of the invention, there is provided an air conditioner, wherein the cleaning brush brought into contact with a side of the rear face of the air filter includes: a frame escaping groove at a portion thereof opposed to the bridge frame.

According to an embodiment of the invention, there is provided an air conditioner, wherein the transverse rail is provided to be proximate to a start end side and/or a final end side in the direction of moving the air filter.

According to an embodiment of the invention, there is provided an air conditioner, wherein in the cleaning case, cleaning units constituted by arranging upper brushes brought into contact with a side of the surface of the air filter and lower brushes brought into contact with the side of the rear side of the air filter opposedly by interposing the air filter are arranged respectively on a filter inlet/outlet side on one side of the cleaning case and a filter inlet/outlet side on other side thereof, and the controlling element moves the air filter in a predetermined direction by driving the in cleaning driving element to stop and thereafter moves the air filter in a reverse direction by a small amount by reversely rotating the in cleaning driving element.

According to an embodiment of the invention, there is provided an air conditioner, wherein the starting end side in the direction of moving the air filter is provided with a flat face having a width substantially the same as a width of the cleaning unit.

DETAILED DESCRIPTION OF THE PREFERRED EMBODIMENTS

Figure 1:
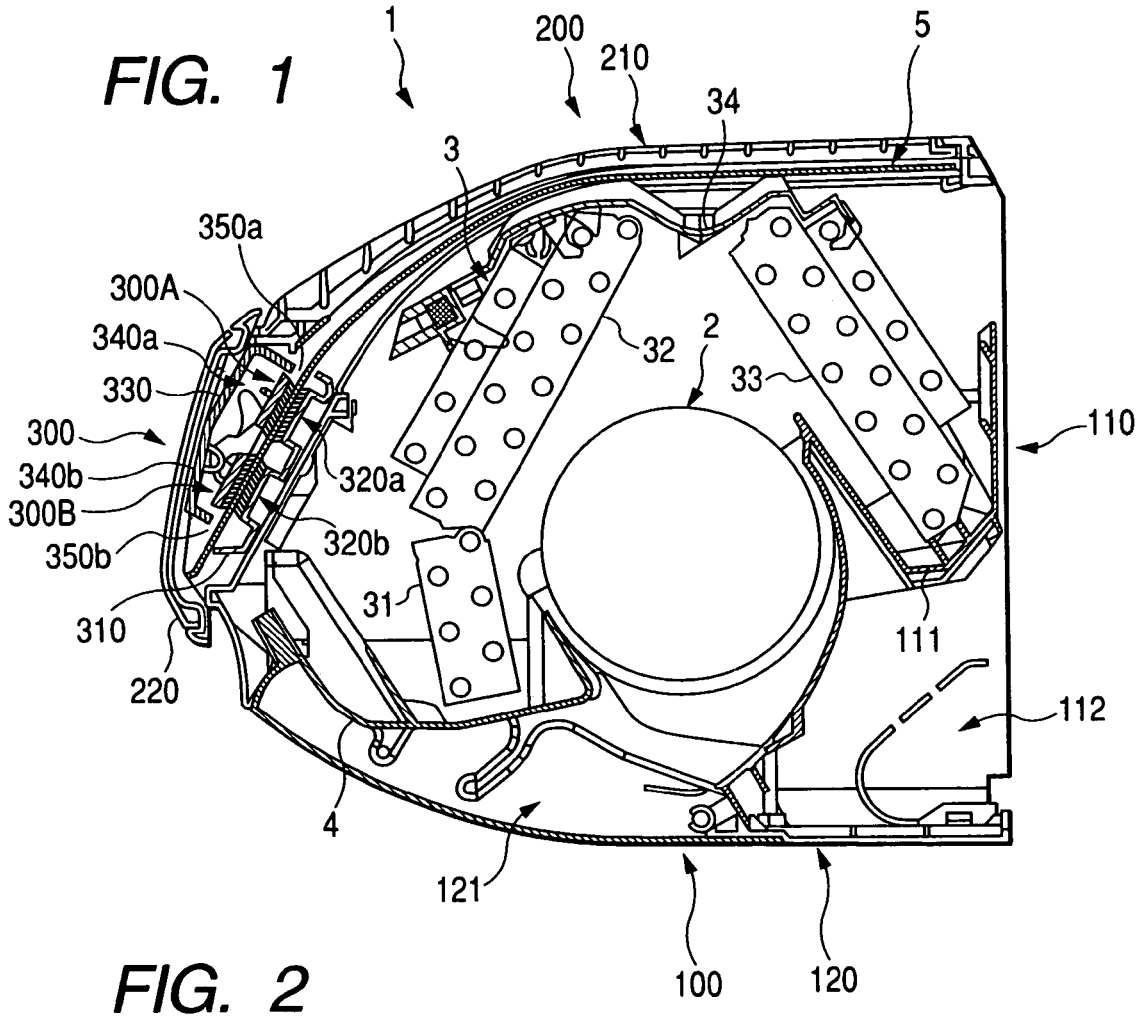
FIG. 1 is a sectional view showing an example of an air conditioner (an interior unit thereof) according to the invention.

Next, an explanation will be given of an embodiment of the invention in reference to the drawings. FIG. 1 is a sectional view showing an example of an air conditioner (interior unit thereof) according to the invention.

An interior unit 1 is provided with a based panel 100 installed to a wall face via an attachment metal piece, not illustrated, and an upper face panel 200 attached to the base panel 100 to cover from an upper face of the base panel 100 over to a front face thereof and the both comprise molded products of synthetic resin.

The base panel 100 includes a rear face panel 110 along the wall face in parallel therewith and an under panel 120 formed to expand from a lower end of the rear face panel 110 to a front face thereof and a total thereof is formed by a section in an L-like shape.

The base panel 100 is contained with a cross flow fan 2, as a blowing fan, a heat exchanger unit 3 and a drain pan 4 or the like. Both ends of the base panel 100 are provided with a pair of left and right side plates (not illustrated) for supporting the heat exchanger unit 3 and the heat exchanger unit 3 is hung between the side plates.

According to the example, the heat exchanger unit 3 is constituted by combining to connect three heat exchanger units 31 through 33 substantially in a lambda (λ) shape and is attached to cover an upper portion of the cross flow fan 2.

Top portions of the front side heat exchanger units 31, 32 and the rear face side heat exchanger unit 33 are connected by a connecting plate 34. The connecting plate 34 functions also as a sealing plate for preventing sucked air from bypassing the heat exchanger unit 3. There is provided an electric equipment box (not illustrated) stored with various power source apparatus or electronic parts for driving the interior unit 1 contiguous to one side plate of the base panel 100.

The rear face panel 110 is formed with a dew receiving portion 111 for receiving drain water produced by the rear face side heat exchanger unit 32 and a lower portion of a rear face of the dew receiving portion 111 is provided with a containing portion 112 for containing various pipes or electric wires.

The under panel 120 is formed with an air blow out port 121 for blowing out air into a room by air blowing operation of the cross fan 2. According to the example, the air blow out port 121 may be provided with, for example, a diffuser opened in a direction of a floor in rapid warming or rapid cooling operation other than an upward/downward directing plate and a leftward/rightward directing plate for changing a direction of blowing air (both thereof are not illustrated).

The base panel 100 is attached with the upper face panel 200 to cover the heat exchanger unit 3. The upper face panel 200 is fixed to an upper end of the rear face panel 110 of the base panel 100 via a locking claw, not illustrated, provided at a rear end side thereof and a front end thereof is hung in an arch-like shape to a front end side of the under panel 120.

According to the example, the upper face panel 200 is provided with an air sucking port 210 over substantially total face thereof. The air sucking port 210 may be formed in a grill rail shape and it is preferable that an opening area thereof is larger than an upper projected area of the heat exchanger unit 3.

According to the example, a front face of the upper face panel 200 is provided with an opening/closing panel 220 pushed to be opened by an air filter moved to outside of the interior unit. The opening/closing panel 220 is axially supported rotatably centering on an upper end side thereof and in moving forward an air filter 5 (in moving to be discharged to outside of the interior unit), other end side thereof is lifted by the air filter 5, thereby, the air filter 5 is extracted to outside of the interior unit.

Figure 2:
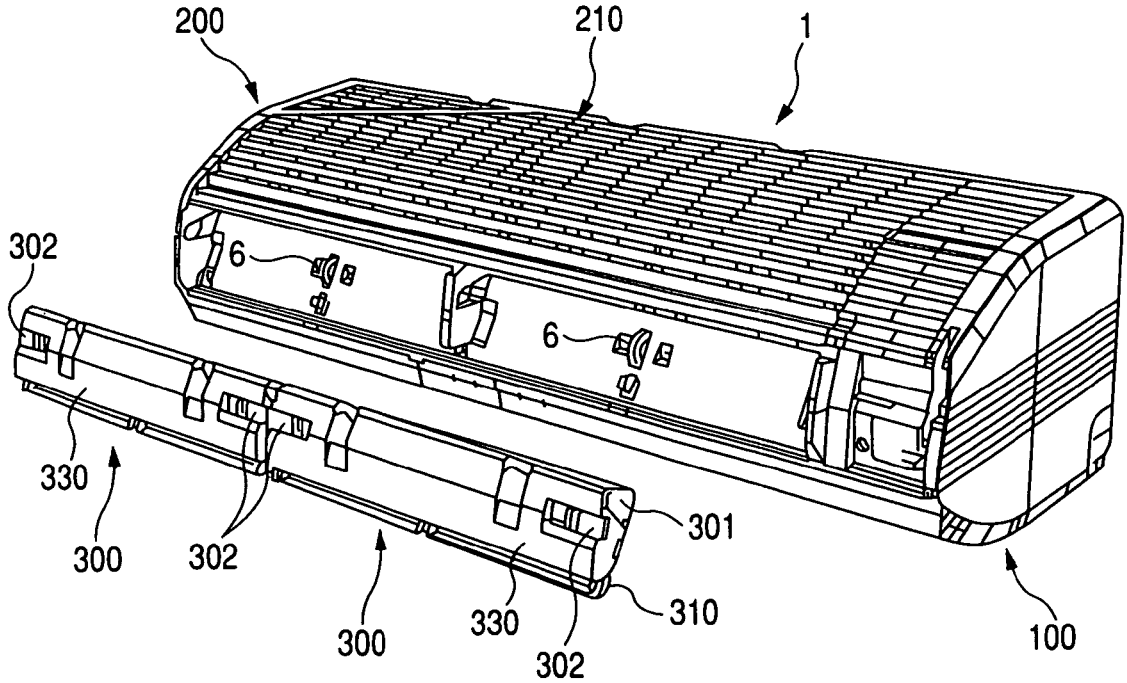
FIG. 2 is a disassembled perspective view showing a state of removing a filter cleaning portion of the air conditioner.

As shown by FIG. 2, the front face of the upper face panel 200 is further provided with a drive motor (not illustrated) as filter driving element and a portion of a drive gear 6 connected to the drive motor is disposed at a portion of the upper face panel 200. The drive motor is controlled by controlling element.

An inner side (side of the heat exchanger 30) of the upper face panel 200 is arranged with the air filter 5 for catching dust in air along the air sucking port 210. A rear face side (side of the heat exchanger 3) of the air filter 5 is provided with a rack gear (not illustrated) brought in mesh with the drive gear 6 and the air filter 5 is reciprocated by a combination of the rack gear and the drive gear 6.

Although according to the example, the air filter 5 constituted by pasting a filter sheet in a net-like shape to a frame made of synthetic resin is used, the air filter 5 may be a general air filter used in an air conditioner.

A filter cleaning portion 300 for removing dust adhered to the air filter 5 is provided between the upper face panel 200 and the opening/closing panel 220. Although in this example, the interior unit 1 is installed with two sheets of the air filters 5 and also the filter cleaning portions are installed at two portions thereof in accordance therewith, both of the respective filter cleaning portions 300 are constructed by the same constitution and therefore, one of the filter cleaning portions 300 will be explained.

Figure 3:
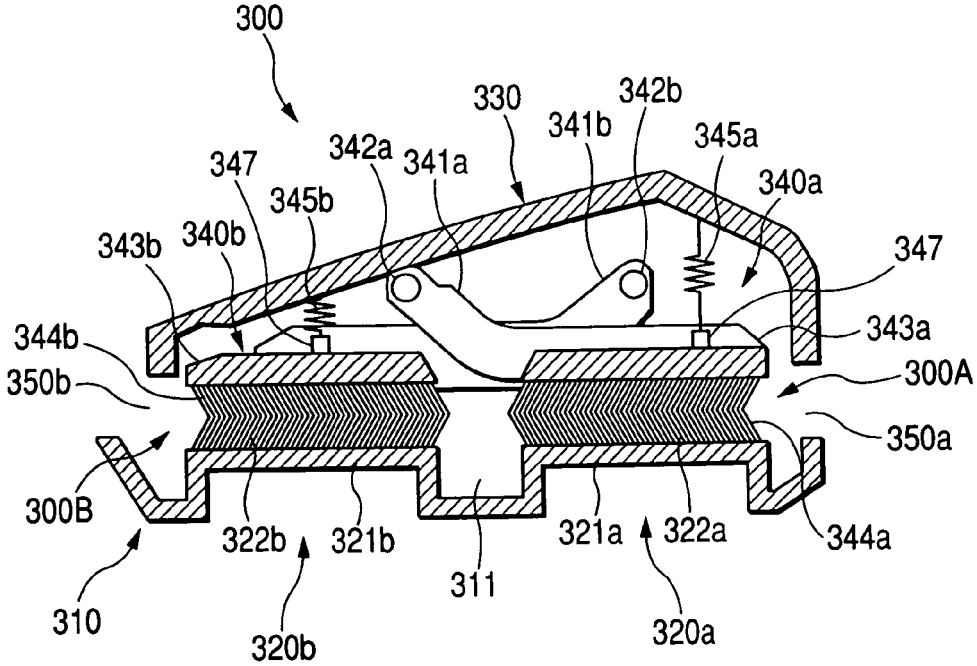
FIG. 3 is a sectional view of an essential portion of the filter cleaning portion.
Figure 4:
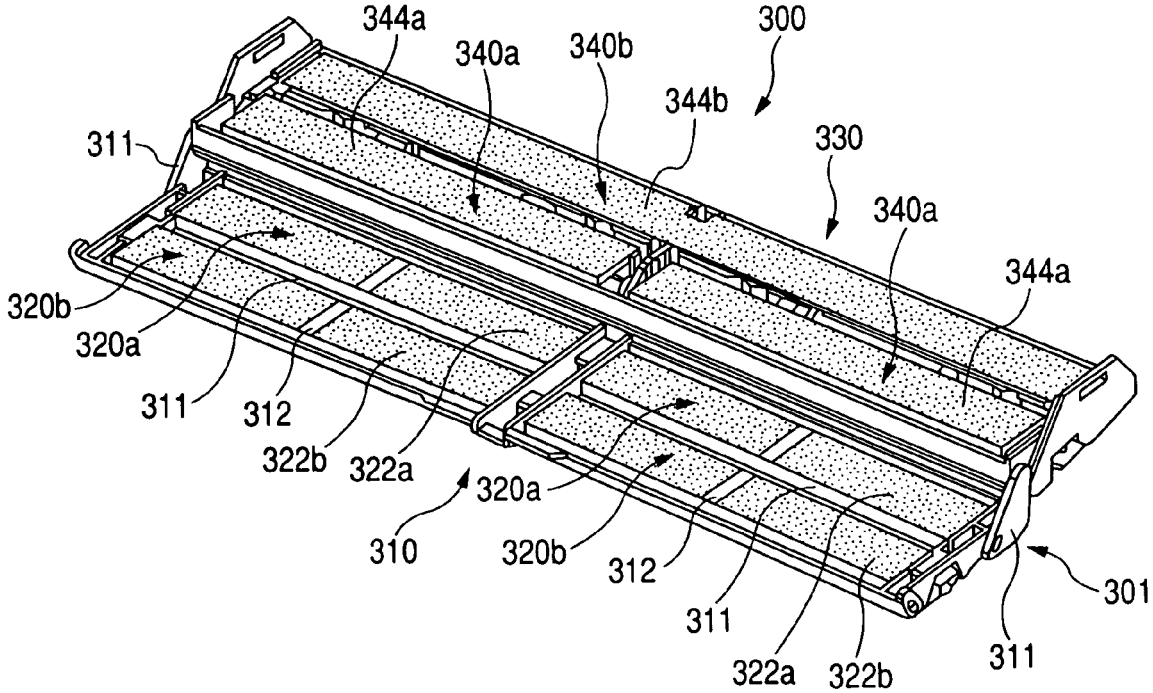
FIG. 4 is a perspective view showing a state of opening the filter cleaning portion.

In reference to FIG. 3 and FIG. 4, the filter cleaning portion 300 is provided with a dust box comprising a bottom cover 310 mounted on a side of the upper panel 200 and a top cover 330 covered on the bottom cover 310. When the dust box is made of synthetic resin, it is preferable that a resin material thereof includes a fungus resisting agent or a bacteria resisting agent.

As shown by FIG. 4, one end sides of the bottom cover 310 and the top cover 330 are connected via a hinge portion 301 and other end sides thereof can be opened and closed. As shown by FIG. 2, both ends of the top cover 330 are provided with lock levers 302 of a sliding type for locking to the bottom cover 310.

The bottom cover 310 is formed in a shape of a slender pen pan having a containing space 311 capable of containing dust at inside thereof. The bottom cover 310 is provided with a length at least longer than a width of the air filter 5. Inside of the bottom cover 310 is provided with a pair of first cleaning portions 320*a*, 320*b* brought into contact with the rear side face (side of the heat exchanger) of the air filter 5.

A bottom portion of the bottom cover 310 is integrally formed with brush bases 321*a*, 321*b* and the first cleaning portions 320*a*, 320*b* substantially comprise lower brushes 322*a*, 322*b* implanted at the brush bases 321*a*, 321*b*. A portion of the containing space 311 as a dust recovering portion is arranged between the dust cleaning portions 320*a*, 320*b*.

The lower brushes 322*a*, 322*b* are inclined in directions of being opposed to each other. That is, as shown by FIG. 3, the lower brush 322*a* on one side is inclined in a left skewed upper direction and the lower brush 322*b* on other side is inclined in a right skewed upper direction.

In reference to FIG. 4, the first cleaning portions 320*a*, 320*b* (lower brushes 322*a*, 322*b*) are arranged at respective two portions along a longitudinal direction of the bottom cover 310. Further, although according to the example, the first cleaning portions 320*a*, 320*b* are divided in two (a total thereof is divided in four) by escaping grooves 312 for escaping frames, not illustrated, of the filter 5 disposed therebetween, each of the first cleaning portions 320*a*, 320*b* may be constituted by one sheet along the longitudinal direction of the bottom cover 320.

Next, the top cover 330 is attached to close a peripheral edge of the opening portion of the bottom cover 310, formed by a box member at least longer than the width of the air filter 5 and is provided with a hollow containing space 331 at inside thereof.

Both side faces on sides of connecting ends of the top cover 330 are provided with bearing plates 311, 311 and by axially supporting a rotating shaft provided at the bearing plates 311, 311 by bearing holes of the bottom cover 310 (both thereof are not illustrated), the top cover 330 is openably and closably supported.

Inside of the containing spacer 331 of the top cover 330 is provided with second cleaning portions 340*a*, 340*b* brought into contact with a surface (face on the side of the air sucking port 210) of the air filter 5 to remove dust. As shown by FIG. 3, the second cleaning portions 340*a*, 340*b* are respectively provided at positions opposed to the first cleaning portions 320*a*, 320*b* by interposing the air filter 5.

The second cleaning portions 320*a*, 340*b* are provided with armed portions (pivoting arms) 341*a*, 241*b* respective one end sides of which are axially supported rotatably by the top cover 330, brush bases 343*a*, 343*b* attached to free end sides of the arm portions 341*a*, 341*b*, and upper brushes 344*a*, 344*b* provided on the brush bases 343*a*, 343*b*.

As shown by FIG. 3, the arm portions 341*a* on one side is formed substantially in an L-like shape from an upper face of the top cover 330 to an opening face (lower face) and one end side thereof is provided with a rotating shaft 342*a*. Other end side of the arm portions 341*a* is integrally formed with the brush face 343*a*.

Also the arm portion 341*b* on other side is similarly formed substantially in an L-like shape from the upper face of the top cover 330 to the opening face (bottom face) and one end side thereof is provided with the rotating shaft 342*b*. Other end side of the arm portion 341*b* is integrally formed with the brush base 343*b*.

As shown by FIG. 3, the respective arm portions 341*a*, 341*b* are axially supported by the upper face of the top cover 340 to respectively interest with each other. That is, the rotating shaft 342*a* of the arm portion 341*a* is installed on an upper portion side of the brush base 343*b* of the second cleaning portion 340*b* and the rotating shaft 342*b* of the arm portion 341*b* is installed on an upper portion side of the brush base 343*a* of the second cleaning portion 340*a*.

A lower side face of the brush base 343*a* on one side is constituted by a flat brush face and the brush face is provided with the upper brush 344*a* on one side. Also a lower face side of the brush base 343*b* is similarly constituted by a flat brush face and the brush face is provided with the upper brush 344*b* on other side.

Figure 5:
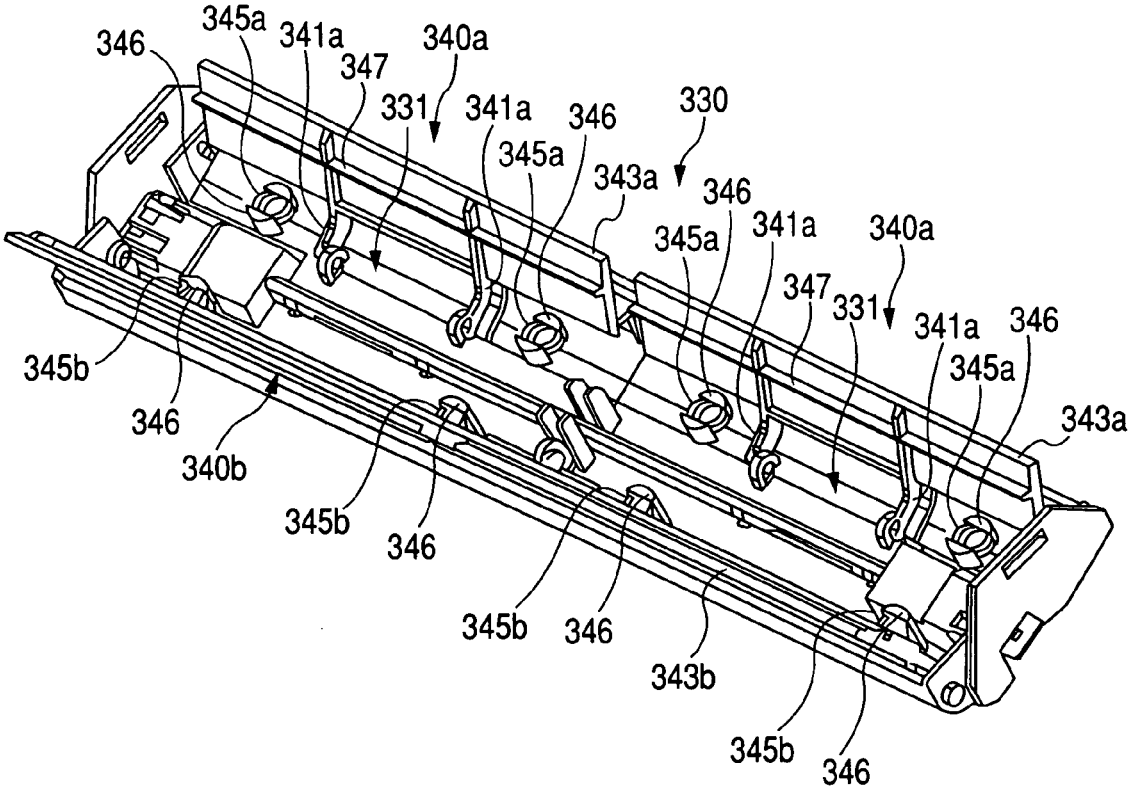
FIG. 5 is a perspective view showing a state of further opening a brush base of a top cover of the filter cleaning portion.

In this example, as shown by FIG. 4, the brush base 343*a* on one side is arranged to be divided in two along the length direction of the top cover 330 and respectives thereof are provided to open and close centering on the rotating shaft 342*a* as shown by FIG. 5.

Further, the brush base 343*b* on other side is constituted by one sheet of a plate member formed along the length direction of the top cover 330 and is provided to open and close centering on the rotating shaft 342*b* similarly as shown by FIG. 5.

Also the respective upper brushes 344*a*, 344*b* are inclined in directions of being opposed to be each other similar to the lower brushes 322*a*, 322*b*. That is, the upper brush 344*a* on one side is inclined to be directed in a left skewed lower direction and the upper brush 344*b* on other side is inclined to be directed in a right skewed lower direction.

In reference to FIG. 3 and FIG. 5, according to the example, there are provided compression springs 345*a*, 345*b* as pressing means for always pressing the brush bases 343*a*, 343*b* in a direction of the air filter 5 (lower direction in FIG. 3) between the top cover 330 and the respective brush bases 343*a*, 343*b*.

The compression springs 345*a*, 345*b* are contained in holding portions 346 in a shape of a cylinder a portion of which is notched on upper face sides (opposed to both sides of the brush bases 343*a*, 343*b*) respectively provided at the top cover 330. The compression springs 345*a*, 345*b* presses the brush bases 343*a*, 343*b* via ribs 347 provided on the rear face sides (opposed to sides of the inclined brushes) of the brush bases 343*a*, 343*b*.

Both end portions of the dust box comprising the top cover 330 and the bottom cover 310 constitute filter inlet/outlet 350*a*, 360*b* for drawing the air filter 5. The lower brush 322*a* of the first cleaning portion 320*a* and the upper brush 344*a* of the second cleaning portion 340*a* are paired to be used as a cleaning unit 300A on a side of the filter inlet/outlet 350*a* on one side and the lower brush 322*b* of the first cleaning portion 320*b* and the upper brush 344*b* of the second cleaning portion 340*b* are paired to be used as a cleaning unit 300B on a side of the filter inlet/outlet 350B on other side.

Figure 8:
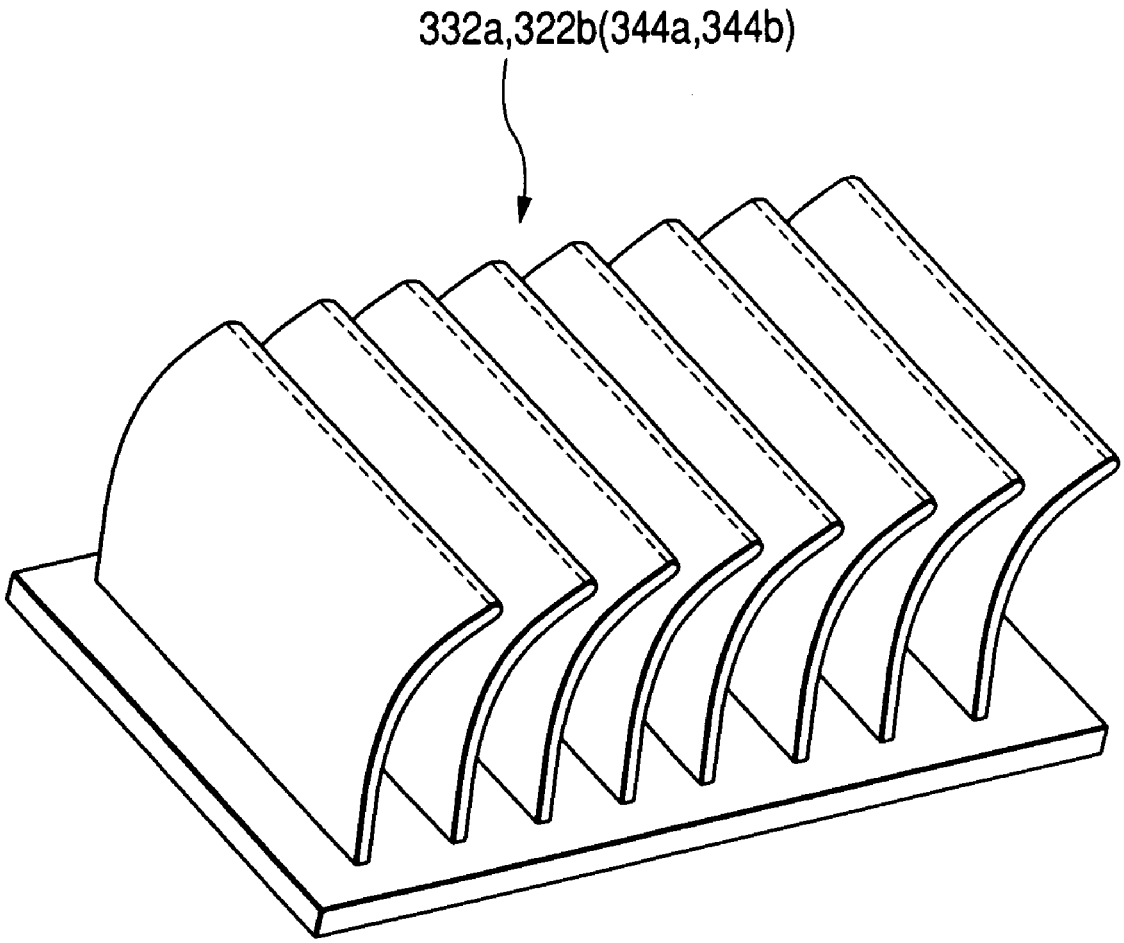
FIG. 8 is a perspective view showing a modified example of a cleaning brush.

In this example, although the first cleaning portions 320*a*, 320*b* are of a fixed type, the first cleaning portions 320*a*, 320*b* may be of a spring-urged type and may be similarly applied with a variable lever mechanism adopted in the second cleaning portions 340*a*, 340*b*. Further, although according to the example, the upper brushes 344*a*, 344*b* and the lower brushes 322*a*, 322*b* are constructed by a constitution of bundling a number of wire-like brushes, otherwise, a constitution of aligning plate brushes in a fin-like shape along a direction of moving the air filter 5 as shown by FIG. 8 may be used therefor.

Next, an example of operation of the filter cleaning portion 300 will be explained in reference to FIGS. 6A through 6C. Although a portion of the air filter 5 is always placed in the filter cleaning portion, FIG. 6A shows a state when the air filter 5 is drawn into the interior unit 1 as shown by FIG. 1 to cover the air suction port of the upper face panel 200.

Figure 6A:
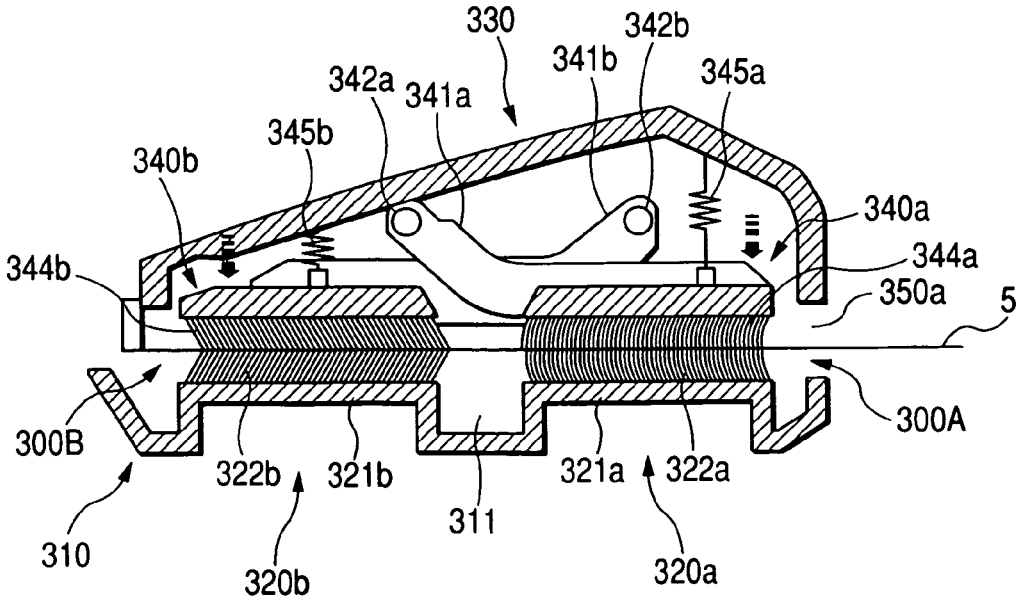
FIGS. 6 A-C illustrate explanatory views for explaining operation of the filter cleaning portion.
Figure 6B:
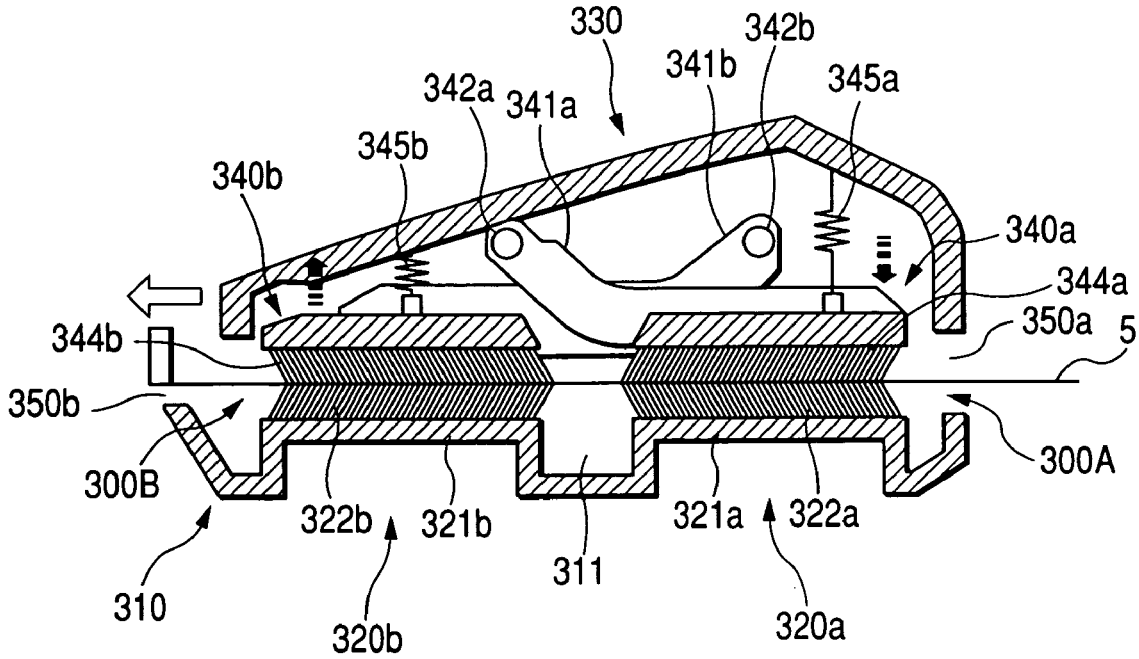

In the case in which the air filter 5 is brought into a state of FIG. 6A, when a filter cleaning instruction signal is issued from, for example, a remote controller, a motor, not illustrated, is driven and the air filter 5 is started to move in a forward direction (discharging direction) indicated by an arrow mark directed to the left of FIG. 6B. In this case, the filter inlet/outlet 350*a* becomes "inlet side" and the filter inlet/outlet 350*b* on other side becomes an "outlet side".

In moving in the forward direction, the air filter 5 is moved in a so-to-speak forward direction without being opposed to the inclining directions of the lower brush 322*a* and the upper brush 344*a* inclined in the cleaning unit 300A on the side of the inlet 350*a*.

Although the upper brush 344*a* on a movable side is urged to be brought into close contact with the air filter 5 by the compression spring 345*a*, since the air filter 5 is moved in the forward direction and in view of a relationship of an axial position of the rotating shaft 342*a* of the arm portion 341*a* supporting the upper brush 344*a*, the upper brush 344*a* is further strongly brought into close contact with the air filter 5.

By rubbing the air filter 5 by the lower brush 322*a* and the upper brush 344*a*, dust adhered to the air filter 5 is exfoliated by respective brushes to gather together. Further, by piercing the tip of the brush into the mesh of the filter, dust stored at the mesh of the filter is scraped.

On the other hand, the lower brush 322*b* and the upper brush 344*b* included in the cleaning unit 300B on the side of the outlet 350*b* constitute a so-to-speak rearward direction directed to be opposed to the direction of moving the air filter 5 and therefore, the upper brush 344*b* on the movable side is going to be floated up from the air filter 5 in view of the relationship with the axial position of the rotating shaft 342*b* of the arm portion 341*b* supporting the upper brush 344*b*, the upper brush 344*b* is hampered from being floated up by the compression spring 345*b*.

Thereby, dust scraped by the cleaning unit 300A on the side of the inlet 350*a* is scraped off to the dust recovering portion 311 in the cleaning unit 300B on the side of the outlet 350*b* and dust stored in the dust box of the filter cleaning portion 300 is not carried to inside of a room by the air filter 5.

Figure 6C:
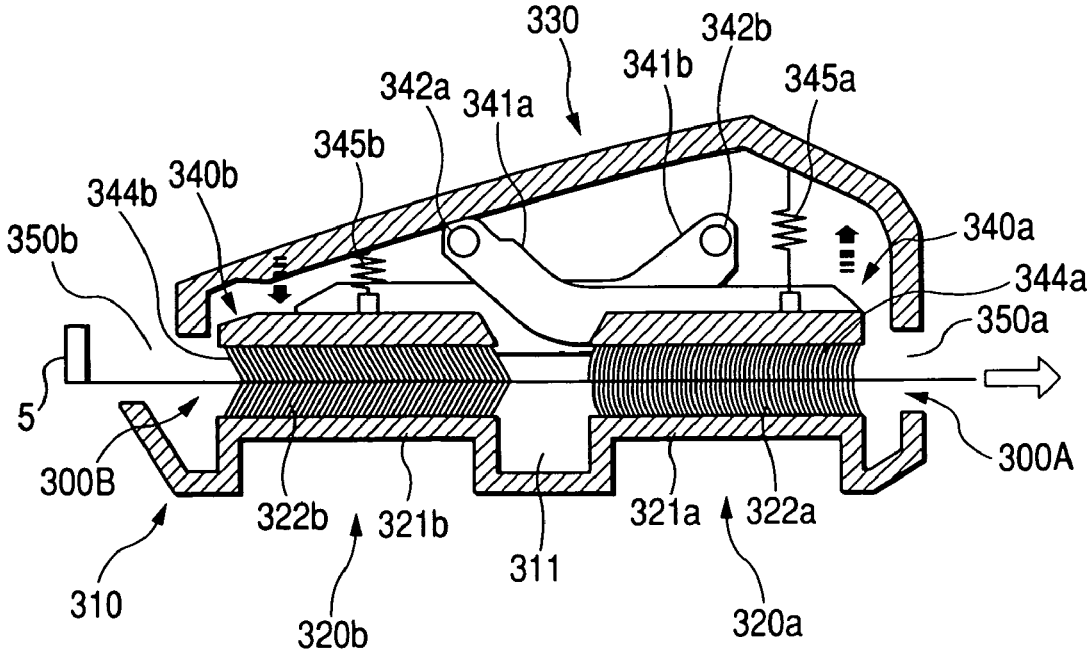

When the air filter 5 finishes to move in the forward direction, the motor, not illustrated, is rotated reversely and in this case, the air filter 5 starts moving in the rearward direction (containing direction) indicated by an arrow mark directed to the right of FIG. 6C. At this occasion, the filter inlet/outlet 350*b* becomes "inlet side" and the filter inlet/outlet 350*a* becomes "outlet side".

In moving the air filter 5 in the rearward direction, the cleaning unit 300B on the side of the inlet 350*b* is operated similar to the cleaning unit 300A in moving in the forward direction and the cleaning unit 300A on the side of the outlet 350*a* is operated similar to the cleaning unit 300B in moving in the forward direction. Therefore, dust stored in the dust box of the filter cleaning portion 300 is not carried into the interior unit 1 by the air filter 5.

According thereto, by cleaning dust remaining on the air filter 5 and vibrating the brush by utilizing a contact resistance with the air filter 5, so-to-speak self-cleaning can be carried out for dropping dust interposed among the brushes into a dust box.

When inside of the filter cleaning portion 300 becomes full with dust, the filter cleaning portion 300 may be taken out to open by opening the upper face panel 200 and dust stored therein may be recovered by sucking dust by a cleaner or the like.

Further, the upper brushes 344*a*, 344*b* may be constituted by fixed brushes similar to the lower brushes 322*a*, 322*b* and such a mode is included in the invention, however, by making the upper brushes 344*a*, 344*b* movable against urge forces of the compression springs 345*a*, 345*b* as in the above-described example, the friction resistance between the upper brush on the side of constituting the rearward direction and the air filter 5 is reduced and therefore, a load of the motor can be alleviated. Further, the lower brush side may be made to be movable and the upper brush side may be fixed, or both of the lower brush and the upper brush may be made to be movable.

As other example, as shown by FIG. 7, a pressing cam 360 can also be used as means for pressing the upper brush. The pressing cam 360 is for further ensuring to scrape off dust in moving the air filter 5 in the forward direction and therefore, as shown by FIG. 7, the pressing cam is preferably provided on the side of the cleaning unit 300A on one side (further preferably, on the side of the upper brush 340*a*), the pressing cam 360 may be provided on the side of the cleaning unit 300B on other side as needed. The following explanation is for a case of providing the pressing cam 360 on the side of the cleaning unit 300A on one side and the cleaning unit 300B on other side remains unchanged from the above-described example.

As shown by FIG. 7, the pressing cam 360 is arranged at a position of being opposed to the upper brush 344*a* included in the cleaning unit 300A on one side at inside of the top cover 310, and rotation thereof is controlled in accordance with the direction of moving the air filter 5 by a control portion, not illustrated.

Figure 7A:
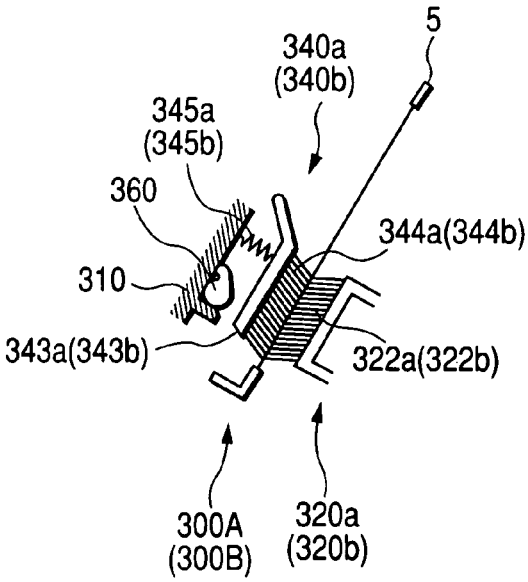
FIGS. 7 A-D illustrate explanatory views for explaining a modified example of pressing element of the filter cleaning portion.

FIG. 7A shows a state when the air filter 5 is drawn into the interior unit 1 to cover the air suction port of the upper face panel 200 as shown by FIG. 1 similar to FIG. 6A. In the initial state, the pressing cam 360 is rotated to a position remote from the upper brush 344*a* such that extra load is not applied to the upper brush 344*a* and the lower brush 322*a*.

Figure 7B:
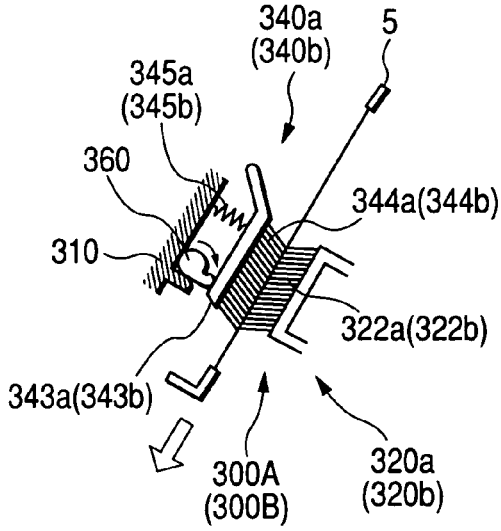

When a cleaning instruction signal is issued and the air filter starts moving in the forward direction indicated by an arrow mark of FIG. 7B, the pressing cam 360 is rotated by about 90° in the clockwise direction to press the upper brush 344*a* to the air filter 5. Thereby, the air filter 5 is pinched between the upper brush 344*a* and the lower brush 322*a* by a force stronger than the urge force by the compression spring 345*a*.

Figure 7C:
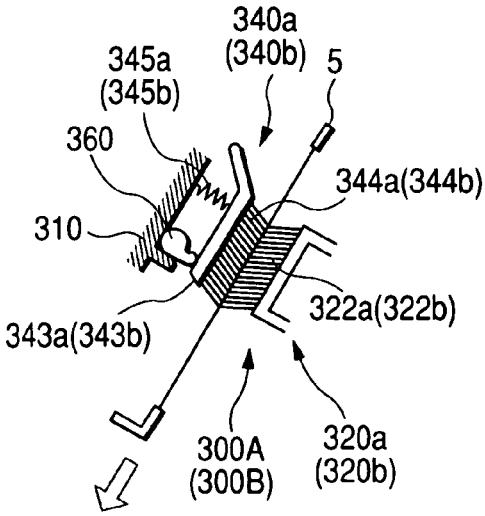
Figure 7D:
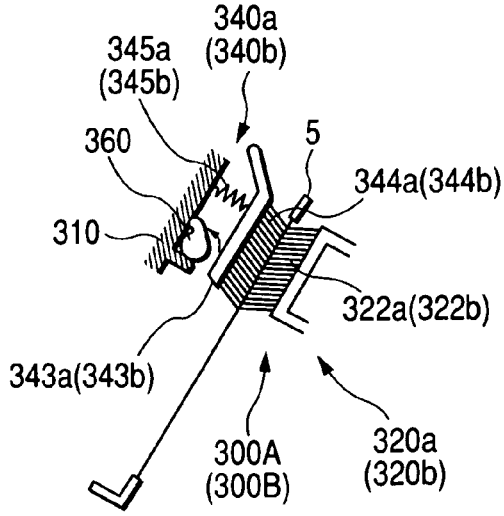

Under the state, as shown by FIG. 7C, the air filter 5 is stopped to move to a time point at which the air filter 5 is moved to a final end and the final end is detected by a sensor, not illustrated, and as shown by FIG. 7D, the pressing cam 360 is also rotated by about 90° in the counterclockwise direction to return to a position of FIG. 7A. Under the state, the air filter 5 is moved in the rearward direction to be drawn into the interior unit 1. Operation in moving in the rearward direction is the same as in the above-described example.

Further, when the pressing cam 360 is provided also on the side of the cleaning unit 300B on other side, the pressing cam 360 presses the upper brush 344 on the side of cleaning unit 300B in moving the air filter 5 in the rearward direction.

As still other example, since the pressing force of the pressing cam 360 can be adjusted by a rotational angle thereof, only the pressing cam 360 can also be used in place of the compression springs 345*a*, 345*b*. That is, in the upper brushes 344*a*, 344*b*, the upper brush constituting the inlet side of the air filter 5 is exerted with a strong force by the pressing cam 360 and the pressing force by the pressing cam 360 is weakened for the upper brush constituting the outlet side.

Further, although according to the above-described example, as shown by FIG. 1, the air filter 5 is moved relative to the filter cleaning portion 300, the position of the air filter 5 may be fixed and a side of the filter cleaning portion 300 may be moved along the air filter 5.

Figure 9:
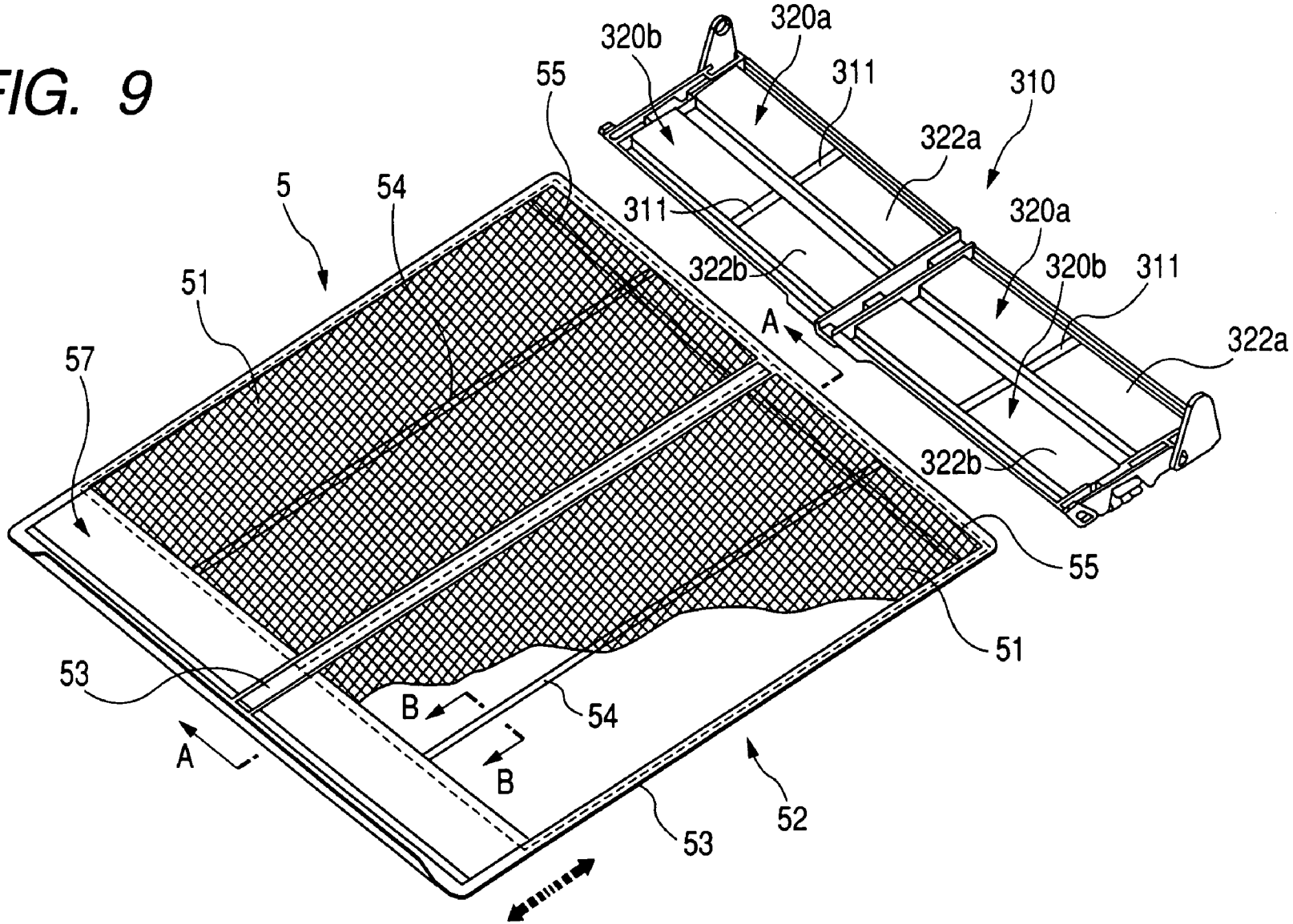
FIG. 9 is a perspective view of an air filter installed in the interior unit.

Next, as shown by FIG. 9, the air filter 5 is provided with a filter sheet 51 in a meshed shape for catching dust and a frame 52 for supporting the filter sheet 51. Further, in this example, two sheets of the air filters 5 are provided to cover the heat exchanger 3.

The filter sheet 51 comprises a sheet member made of a synthetic resin of polypropylene or the like and is preferably subjected to a fungus resisting processing, a bacteria resisting processing and an electricity conduction preventing processing for preventing charging by the brush. Although according to the example, the filter sheet 5 is made of polypropylene, a material, a mesh or the like thereof can be changed arbitrarily in accordance with the specification.

The frame 52 is constituted by a main frame 52 in a rectangular shape having an area of substantially a half of an opening area of the air suction port 210 and at a center of the main frame 52, a rail frame 53 is formed in parallel along the direction of moving the air filter 5 (arrow mark direction in FIG. 9).

Figure 10:
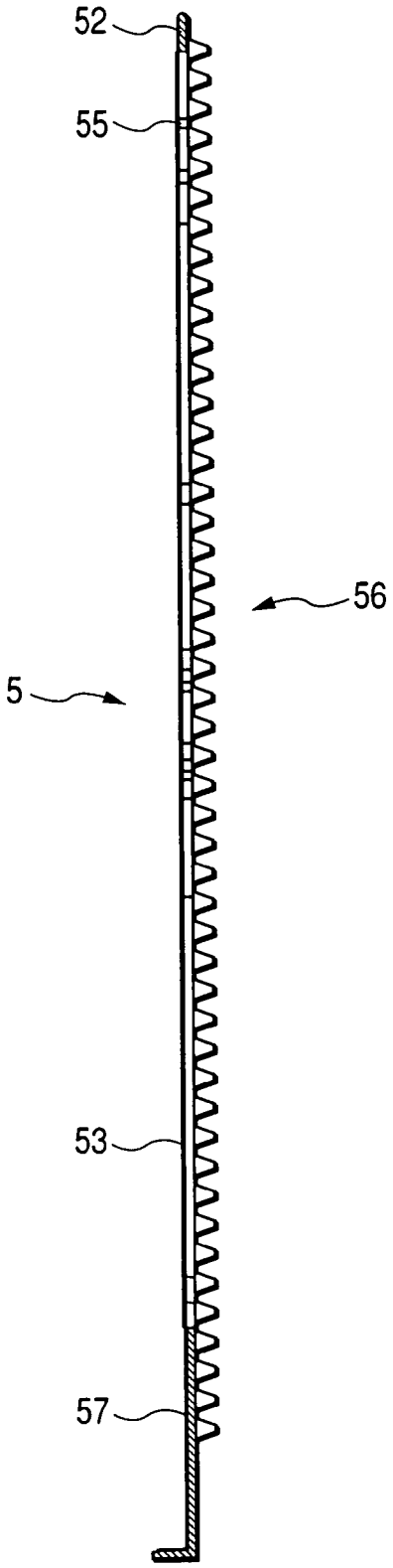
FIG. 10 is a sectional view taken along a line A-A of FIG. 9.

As shown by a sectional view of FIG. 10 taken along a line A-A of FIG. 10, the rail frame 53 is made to hang on the main frame 52 in parallel along the filter moving direction and a rear face side (right side face side of FIG. 3) is formed with a rack gear 56 with which a drive gear (not illustrated) provided on the side of the interior unit 1 is brought in mesh.

The filter sheet 51 is expanded at two portions of opening portions (filter faces) surrounded by the main frame 52 and the rail frame 53. In this example, the filter sheet 51 is integrally formed with the frame 52 by insert molding. Further, the filter sheet 52 may be pasted to the frame 51.

The filter face surrounded by the main frame 52 and the rail frame 53 is provided with a longitudinal rail 54 and a transverse rail 55 for supporting the filter sheet 51. The longitudinal rail 54 is formed in parallel along the direction of moving the air filter 5 and the transverse frame 55 is formed in a direction orthogonal to the direction of moving the air filter 5.

Figure 11:
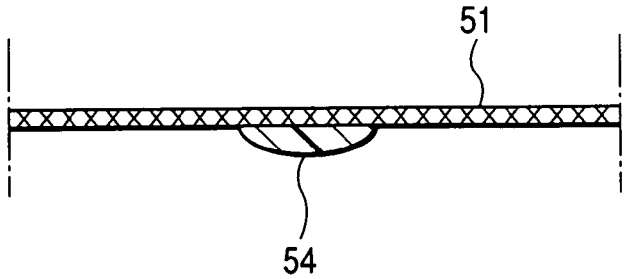
FIG. 11 is a sectional view taken along a lone B-B of FIG. 9.

Both of the longitudinal rail 54 and the transverse rail 55 are formed on a rear face side (rear side of paper face in FIG. 9) of the filter sheet 54. As shown by a sectional view of FIG. 11 taken along a line B-B of FIG. 9, the longitudinal rail 54 is formed such that in a sectional shape thereof on a surface side (side opposed to the filter sheet 51), a height thereof is gradually reduced as proceeding from a top side thereof to both sides thereof in this example, the longitudinal rail 54 is formed in a semicylindrical shape (convex curved face shape) in a section thereof having the height of the top portion of 1.5 mm.

Figure 13A:
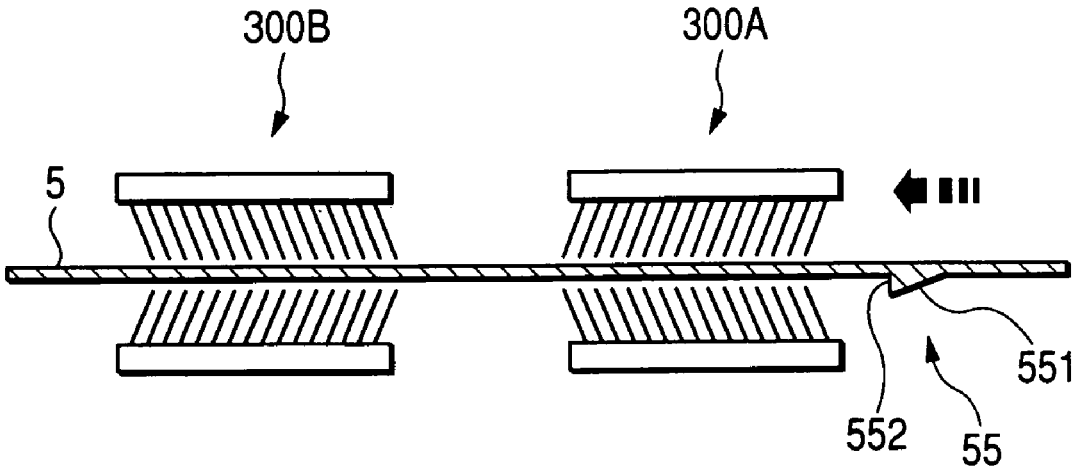
FIGS. 13 A and B illustrate explanatory views for explaining a constitution of a transverse rail and operation thereof.

As shown by FIG. 13A, the transverse rail 55 is formed in a triangular shape in a section thereof including an inclined face 551 gradually inclined in the direction of moving the air filter 5 (arrow mark direction in the drawing) by a predetermined angle, and an erected face 552 erected substantially orthogonal to the direction of moving the air filter.

Figure 13B:
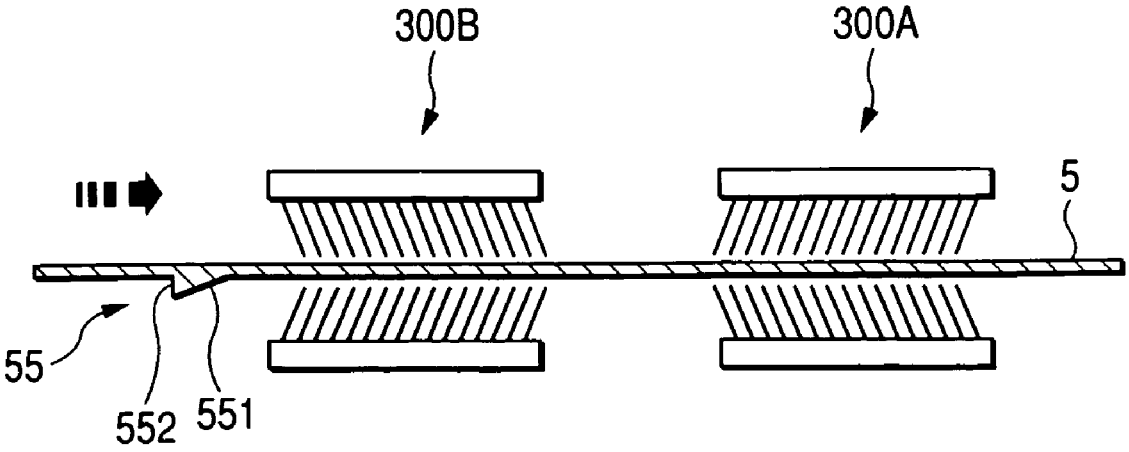

According thereto, in moving in the forward direction (refer to FIG. 13A), dust piled on the inlet side of the cleaning unit 300A can be drawn into the dust box by the erected face 552 and in moving in the rearward direction (refer to FIG. 13B), the air filter 5 can be recovered into the cabinet smoothly by drawing the air filter 5 along the inclined face 551.

The transverse rail 55 is formed at a predetermined interval (in this example, about ⅓ of the width of the filter face 51) from a rear end side (right upper side of FIG. 9) of the air filter 5. That is, the transverse frame 55 is a reinforcement member provided for reinforcing the air filter 5 and can effectively reinforce the air filter 5 by being provided at an end portion applied with a deforming stress particularly in moving. A starting end side of the air filter 5 refers to a front end side in moving in the forward direction (left lower side of FIG. 9) and a rear end side refers to a final end side thereof.

According thereto, since nothing is present on the surface side (side of the air suction port 210) of the filter sheet 51, not only dust can efficiently be caught but also caught dist can firmly be recovered by the filter cleaning portion 300, mentioned later.

Although in this example, the longitudinal rail 54 and the transverse rail 55 are provided only on the rear face side of the air filter 5, in such a case, there is a case in which an outlook of the surface is poor. Therefore, a bridge rail having a height to a degree of not influencing recovery (about 0.2 mm for surface side relative to 1.5 mm of a top portion of the rear face) may be formed also on the surface side.

In reference to FIG. 9 again, the air filter 5 is provided with a flat portion 57 for aligning the tips of the cleaning brushes 322, 344 provided in the cleaning portion 300. The flat portion 57 is formed in a shape of a flat plate along the filter face at the front end side (left lower side of FIG. 9) of the main frame 51.

The flat portion 57 is formed to provide a length more or less longer than the brush width of the cleaning brushes 322, 344 in the filter cleaning portion 300, mentioned later. Also the flat portion 57 is formed by integral molding in molding the frame 51.

In FIG. 3, the bottom cover 310 is formed in a shape of a pen pan having the containing space 311 capable containing dust at inside thereof and is formed to be longer at least than the width of the air filter 5.

The inner portion (bottom portion) of the bottom cover 310 is provided with the pair of first cleaning portions 320*a*, 320*b* brought into contact with the rear face side (heat exchanger side) of the air filter 5. The first cleaning portions 320*a*, 320*b* are provided at the brush bases 321*a*, 321*b* integrally formed with the bottom portion of the bottom cover 310 and a portion of the containing space 311 is formed between the first cleaning portions 320*a*, 320*b*.

The brush bases 321*a*, 321*b* are integrally molded with the bottom cover 310 in a state of expanding portions of the bottom portion of the bottom cover 310 to direct to the top cover 320 and the bottom face (lower face in FIG. 3) of the bottom cover 310 is recessed in accordance with formation of the brush bases 321*a*, 321*b*.

Although according to the example, the brush bases 321*a*, 321*b* are integrally molded therewith, separate members may be attached thereto. Further, the first cleaning portions 320*a*, 320*b* may forcibly be pressed to the air filter 5 by providing pressing means of compression springs or the like therebetween.

The first cleaning portions 320*a*, 320*b* are implanted with brush wires by a predetermined implanting density and the brush lines comprise inclined brushes brought into contact with the air filter 5 skewedly by a predetermined angle. The first cleaning portions 320*a*, 320*b* are provided to be inclined in directions of being opposed to each other by interposing the containing space 311. That is, as shown by FIG. 3, the lower brush 322*a* on one side is installed to be inclined in the left skewed upper direction and the lower brush 322*b* on other side is installed to be inclined in the right skewed upper direction.

As shown by FIG. 9, it is preferable that the first cleaning portions 320*a*, 320*b* are divided in two (a total thereof is divided in four) by the escaping grooves 311 for escaping the longitudinal frames 54 of the air filter 5 disposed therebetween. According thereto, the filter sheets 51 at vicinities of the longitudinal frames 54 can firmly be cleaned. Further, the first cleaning portions 320*a*, 320*b* may be constituted by one sheet thereof along the longitudinal direction of the bottom cover 320.

In order to remove dust adhered to the surface (side of the air suction port 210), inside of the containing space 331 of the top cover 330 is provided with the pair of second cleaning brushes 340*a*, 340*b* brought into contact the air filter 5. As shown by FIG. 3, the second cleaning portions 340*a*, 340*b* are respectively provided at positions opposed to the first cleaning portions 320*a*, 320*b* by interposing the air filter 5.

The respective one end sides of the second cleaning portions 340*a*, 340*b* are provided with the arm portions (pivoting arms) 341*a*, 341*b* having the rotating shafts 342*a*, 342*b* axially supported rotatably by the top cover 330 and the brash bases 343*a*, 343*b* attached to the free end sides of the arm portions 341*a*, 341*b*.

As shown by FIG. 3, the respective arm portions 341*a*, 341*b* are axially supported to respectively intersect with each other at the upper face of the top cover 330. That is, the rotating shaft 342*a* of the arm portion 341*a* is installed on the upper portion side of the brush base 343*b* of the second cleaning portion 340*b* and the rotating shaft 342*b* of the arm portion 341*b* is installed on the upper portion side of the brush base 343*a* of the first cleaning portion 340*a*.

The lower face side of the brush base 343*a* on one side is constituted by the flat brush face and the brush face is provided with brush wires. Similarly, also the brush base 343*b* on other side is constituted by the flat brush face and brush wires are provided along the brush face.

Both of the upper brushes 344*a*, 344*b* are implanted with brush wires by a predetermined implanting density, the brush wires comprise inclined brushes brought into contact with the air filter 5 skewedly by a predetermined angle. The upper brushes 344*a*, 344*b* are installed to be inclined in directions of being opposed to each other by interposing the containing space 331. That is, the upper brush 344*a* on one side is arranged to be directed to in the left skewed lower direction and the upper brush 344*b* on other side is arranged to be directed in the right skewed lower direction.

In reference to FIG. 3, the compression springs 345*a*, 345*b* as pressing means for always pressing the brush bases 343*a*, 343*b* in the direction (lower direction in FIG. 3) of the air filter 5 are provided between the top cover 330 and the respective brush bases 343*a*, 343*b*.

The compression springs 345*a*, 345*b* are contained by spring holders (not illustrated) in a cylindrical shape respectively provided at portions of the top cover 330. The compression springs 345*a*, 345*b* press the brush bases 343*a*, 343*b* in the direction of the air filter 5 by being brought into contact with portions of the rear face sides (sides opposed to the inclined brushes) of the brush bases 345*a*, 345*b*.

Thereby, the lower brush 322*a* and the upper brush 344*a* of the filter inlet/outlet 350*a* on one side are paired to be used as the cleaning unit 300A and the lower brush 322*b* and the upper brush 344*b* of the filter inlet/outlet 350*b* on other side are paired to be used as the cleaning unit 300B.

Although according to the example, the first cleaning portions 320*a*, 320*b* are of the fixed type, the variable laver mechanism adopted in the second cleaning portions 340*a*, 340*b* may similarly be adopted therefor. According thereto, the force of catching dust is further increased.

Further, although according to the example, the respective cleaning portions 320, 340 are constituted by bundling a number of brushes in a wire-like shape, otherwise, as shown by FIG. 8, the respective cleaning portions 320, 340 aligned with plate brushes in a fin-like shape in the advancing direction may be used.

Although the upper brush 344*a* on the movable side is urged to be brought into close contact with the air filter 5 by the compression spring 345*a*, since the air filter 5 is moved in the forward direction and in view of the relationship with the axial position of the rotating shaft 340*a* of the arm portion 341*a* supporting the upper brush 344*a*, the upper brush 344*a* is further strongly brought into close contact with the air filter 5. Thereby, the air filter 5 is strongly rubbed by the lower brush 322*a* and the upper brush 344*a* and almost all of dust adhered to the air filter 5 is scraped off.

Thereby, dust which has not been removed by the cleaning unit 300A of the side of the inlet 350*a* is scraped off by the cleaning unit 300B on the side of the outlet 350*b* and dust stored in the dust box of the filter cleaning portion 300 is not carried into a room by the air filter 5.

Further, by proving the frame 52 of the air filter 5 on the rear side (side of the heat exchanger 3) in view from the filter face, there is not a hindrance on the upper face side (side of the air suction port 210) and therefore, dust stored on the upper face of the air filter 5 can firmly be caught by the upper brushes 344*a*, 344*b*.

Figure 12A:
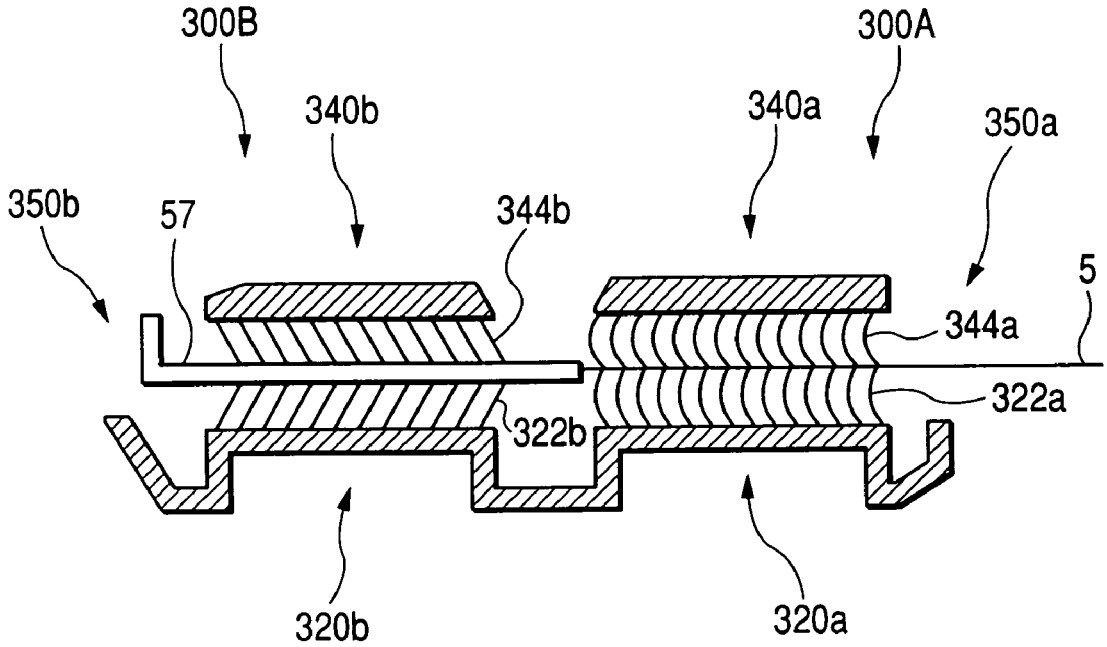
FIGS. 12 A and B illustrate explanatory views for explaining a procedure of aligning a tip of a brush in a filter cleaning portion.

When the air filter 5 has been finished to clean, the control portion issues an instruction to the drive motor and pushes back the front end of the air filter 5 to butt the filter cleaning portion 350. As shown by FIG. 12A, when the air filter 5 is completely drawn back into the interior unit 1, since the upper brush 344*a* and the lower brush 322*a* of the cleaning unit 300A are opposed thereto and therefore, the brushes are brought into a warped state relative to the moving direction by being brought into contact with the air filter 5.

When the brushes are left for a long period of time under the state, brush lines are curled in the warped state and therefore, there is a concern of deteriorating the scraping off effect of the brush. Hence, the control portion slides the air filter 5 to the side of the outlet 350*b* by a small amount from the stationary position of the air filter 5.

Figure 12B:
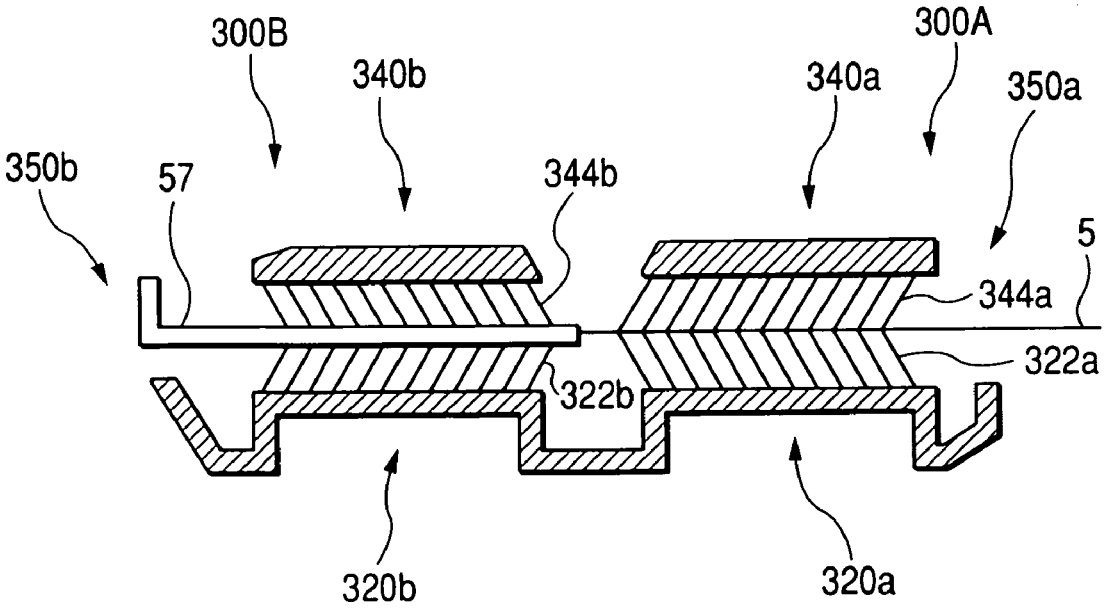

According thereto, as shown by FIG. 12B, according to the upper brush 344*a* and the lower brush 322*a* of the cleaning unit 300A, by drawing back the air filter 5 in the forward direction (left direction of the drawing) by a small amount, the tips of the upper brush 344*a* and the lower brush 322*a* are returned to normal inclined positions.

In this case, by providing the flat portion 57 formed at the smooth face between the upper brush 344*b* and the lower brush 322*b* of the cleaning unit 300B on other side, the flat portion 57 is simply slid without being influenced by friction by the filter face and therefore, the tip is not warped back inversely and the tip is always maintained at a normal inclined position.

According to an embodiment of the invention, by respectively providing the cleaning units including the upper brushes and the lower brushes arranged opposedly to each other at the respective filter inlets/outlets of the cleaning case, dust removed by moving in and out the air filter can firmly be prevented from being carried to outside of the cleaning case again.

According to an embodiment of the invention, both of the upper brushes and the lower brushes in the respective cleaning units are the inclined brushes inclined to the sides of the dust recovering portion (opposed to the sides of the filter inlets/outlets) and therefore, a portion of dust which has not been removed by the brushes on the inlet side is scrapped off by the brushes on the outlet side.

According to an embodiment of the invention, at least one of the upper brush and the lower brush is pressed to the side of the air filter by the pressing element and therefore, with regard to the brush constituting a forward direction for the direction of moving the air filter, performance of adhering to the air filter is further promoted and with regard to the brush constituting a rearward direction therefor, floating up of the brush from the air filter can be suppressed.

According to an embodiment of the invention, by constituting the cleaning case by the bottom cover and the top cover integrated openably and closably, supporting the lower brush by the side of the bottom cover and supporting the upper brush by the side of the top cover, the cleaning case can easily be attached and detached to and from the air filter.

According to an embodiment of the invention, the upper brush on one side and the upper brush on other side are supported by the top cover respectively by the first pivoting arm and the second pivoting arm and therefore, in abandoning dust recovered by opening the cleaning case, the upper brushes can be moved to positions which do not constitute a hindrance and inside of the cleaning case can cleanly be cleaned.

According to an embodiment of the invention, the axis fulcrum of the first pivoting arm relative to the top cover is arranged on the side of the upper brush on other side, in contrast thereto, the axis fulcrum of the second pivoting arm relative to the top cover is arranged on the side of the upper brush on one side and therefore, when the brushes are supported by the top cover via the pivoting arms, a width of the cleaning case can be narrowed.

According to an embodiment of the invention, by using the pressing cam selectively operated in accordance with the direction of moving the air filter as the pressing element of the brushes, a brush pressure on the air filter can further pertinently be controlled.

According to an embodiment of the invention, by forming the frame on the rear face side (side of heat exchanger) of the filter sheet, only the filter face appears on the surface side (side of air suction port) of the filter where dust is stored the most and therefore, not only dust can efficiently be caught but also there is not a nonuniformity in recovering dust by the filter cleaning portion.

According to an embodiment of the invention, by forming the frame on the rear face side in a shape of a semicircular cylinder in a section thereof, when the filter is cleaned by the filter cleaning portion, catching by the cleaning brush can be minimized and also dust adhered to the rear face side of the filter can firmly be recovered.

According to an embodiment of the invention, dust piled up on the inlet side of the cleaning brush can be drawn into the dust box by the erected face in moving in the forward direction and the air filter can smoothly be recovered into the cabinet by being drawn along the inclined face in moving in the rearward direction.

According to an embodiment of the invention, by providing the escaping groove of the bridge frame (further preferably, longitudinal frame) at a portion of the cleaning brush, a range of cleaning by the cleaning brush is not hindered by the longitudinal frame and therefore, the air filter 5 can further firmly be cleaned.

According to an embodiment of the invention, by providing the transverse frame at the starting end of the filter and/or the final end on which a load is applied the most in moving the filter, twist or torsion produced in the filter can be minimized and performance of catching dust can be promoted.

According to an embodiment of the invention, after finishing to clean the filter, the cleaning brush is warped to a side opposed to the inclined direction and therefore, by moving the air filter by a small amount in a direction reverse to a moving direction, a warped tip of the inclined brush can be recovered to a correct position and catching force of dust is not reduced even when the brush is used for a long period of time.

According to an embodiment of the invention, by providing the flat face on the starting end side of the air filter, when the air filter is pulled back, the inclined brush on other side can be prevented from being warped back.

Although the invention is explained by taking an example of the interior unit of the air conditioner of a split type in which the exterior unit and the interior unit are separated and a ceiling wall type as described above, the invention is not limited thereto. The invention can widely be utilized in an air conditioner having an air filter of, for example, a floor standing type air conditioner, an integral type air conditioner containing an interior unit and an exterior unit in one cabinet, further in view of a heat source, a gas combustion type, a warm mater circulating type air conditioner and the like.

What is claimed is:

1. An air conditioner comprising:

an interior unit cabinet having an air suction port and an air blow out port, an air filter arranged on an inner side of the air suction port, and a filter cleaning portion located inside of the interior unit cabinet, the filter cleaning portion comprising:

a cleaning case surrounding both of a front surface and a rear face of a portion of the air filter, an in cleaning driving element for moving either one of the air filter or the filter cleaning portion for cleaning the air filter by moving the air filter and the filter cleaning portion relative to each other, a first cleaning unit arranged on a filter inlet/outlet side on one side of the cleaning case, the first cleaning unit in contact with the rear face of a portion of the air filter, a second cleaning unit arranged on a filter inlet/outlet side on another side of the cleaning case, the second cleaning unit in contact with the rear face of a portion of the air filter, a third cleaning unit arranged in the cleaning case in contact with the front surface of a portion of the air filter, and a dust recovering portion located between the first cleaning unit and the second cleaning unit.

2. The air conditioner according to claim 1, wherein the first, second, and third cleaning units include cleaning brushes brought into contact with the air filter, and the cleaning brushes are inclined brushes inclined to sides of the dust recovering portion.

3. The air conditioner according to claim 2, wherein the first and second cleaning units include upper brushes brought into contact with the front surface of the air filter and the third cleaning unit includes lower brushes brought into contact with the rear face of the air filter.

4. The air conditioner according to claim 1, further comprising: pressing element for pressing at least one of the upper brushes and the lower brushes to sides of the air filter inside of the cleaning case.

5. The air conditioner according to claim 3, wherein the cleaning case includes a bottom cover and a top cover integrated openably and closably, the two lower brushes included in the respective cleaning units are respectively supported by a side of the bottom cover, and the two upper brushes included in the respective cleaning units are respectively supported by a side of the top cover.

6. The air conditioner according to claim 5, wherein one of the upper brushes is supported by a first pivoting arm axially supported by the top cover, and other of the upper brushes is supported by a second pivoting arm axially supported by the top cover.

7. The air conditioner according to claim 6, wherein an axis fulcrum of the first pivoting arm relative to the top cover is arranged on a side of the other of the upper brushes, and an axis fulcrum of the second pivoting arm relative to the top cover is arranged on a side of the one of the upper brushes.

8. The air conditioner according to claim 4, wherein as the pressing element, a pressing cam operated selectively in accordance with a direction of moving the air filter is used.

9. An air conditioner comprising:

an interior unit cabinet having an air suction port and an air blow out port, an air filter arranged on an inner side of the air suction port, a filter cleaning portion located inside of the interior unit cabinet, the filter cleaning portion comprising:

a cleaning case surrounding both of a front surface and a rear face of a portion of the air filter, a cleaning brush brought into contact with at least one of the surface and the rear face of the air filter, and an in cleaning driving element for moving either one of the air filter or the filter cleaning portion in the cleaning case for cleaning the air filter by moving the air filter and the filter cleaning portion relative to each other, wherein the air filter comprises a filter sheet supported by a frame comprising:

a main frame for supporting a peripheral edge of the filter sheet, and a bridge frame arranged on at least the rear face of the air filter for supporting a dust catching face of the filter sheet included in the frame, the bridge frame comprising at least one longitudinal rail oriented substantially in parallel to a direction of moving of the air filter, and a transverse rail oriented substantially orthogonal to the direction of moving of the air filter.

10. The air conditioner according to claim 9, wherein the longitudinal rail and/or the transverse rail is formed so that a height thereof is gradually reduced as proceeding from a top portion thereof in a width direction in a sectional shape thereof.

11. The air conditioner according to claim 9, wherein the transverse rail is formed in a triangular shape in a section thereof including an inclined face inclined to the direction of moving the air filter gradually by a predetermined angle and an erected face erected substantially orthogonally to the direction of moving the air filter.

12. The air conditioner according to claim 9, wherein the cleaning brush brought into contact with a side of the rear face of the air filter includes: a frame escaping groove at a portion thereof opposed to the bridge frame.

13. The air conditioner according to claim 10, wherein the transverse rail is provided to be proximate to a start end side and/or a final end side in the direction of moving the air filter.

14. The air conditioner according to claim 9, wherein in the cleaning case, cleaning units constituted by arranging upper brushes brought into contact with a side of the surface of the air filter and lower brushes brought into contact with the side of the rear side of the air filter opposedly by interposing the air filter are arranged respectively on a filter inlet/outlet side on one side of the cleaning case and a filter inlet/outlet side on other side thereof, and the controlling element moves the air filter in a predetermined direction by driving the in cleaning driving element to stop, and thereafter moves the air filter in a reverse direction by a small amount by reversely rotating the in cleaning driving element.

15. The air conditioner according to claim 14, wherein the starting end side in the direction of moving the air filter is provided with a flat face having a width substantially the same as a width of the cleaning unit.

16. The air conditioner according to claim 11, wherein the transverse frame is provided to be proximate to a start end side and/or a final end side in the direction of moving the air filter.

* * * * *